US008007192B2

(12) United States Patent
Huang

(10) Patent No.: US 8,007,192 B2
(45) Date of Patent: Aug. 30, 2011

(54) MAKEUP APPLICATOR

(76) Inventor: Jung-Hui Huang, Taiping (TW)

( * ) Notice: Subject to any disclaimer, the term of this patent is extended or adjusted under 35 U.S.C. 154(b) by 416 days.

(21) Appl. No.: 12/350,850

(22) Filed: Jan. 8, 2009

(65) Prior Publication Data

US 2010/0172688 A1 Jul. 8, 2010

(51) Int. Cl.
*A46B 11/00* (2006.01)
*A46B 13/00* (2006.01)

(52) U.S. Cl. ..... 401/129; 401/126

(58) Field of Classification Search ..... 401/118, 401/121, 122, 124, 126–130
See application file for complete search history.

(56) References Cited

U.S. PATENT DOCUMENTS 7,465,114 B2 * 12/2008 Kress et al. ..... 401/129

* cited by examiner

*Primary Examiner* — Tuan N Nguyen

(57) ABSTRACT

A makeup applicator is provided. The applicator includes a main body, a holding portion, a cushion sleeve, a shaft, a covering ring, an applying element and a rotating rod. The main body includes a vibration motor assembly and a case, the holding portion covers the vibration motor assembly, and the cushion sleeve is sandwiched between the main body and the holding portion. Therefore, the applying element can be driven to vibrate and rotate steadily by the vibration motor assembly no matter where the user holds the holding portion, which facilitates the users makeup.

10 Claims, 4 Drawing Sheets

MAKEUP APPLICATOR

BACKGROUND OF THE INVENTION

1. Field of the Invention

The present invention relates to a makeup applicator which an applying element thereof can rotate and vibrate while a vibration motor works, 2. Description of the Prior Art A conventional vibration makeup applicator, such as disclosed in Taiwan Patent No. M341438, has a vibratable and rotatable brush to apply facial cosmetics. However, there are some defects remained in the conventional art, i.e. the amplitude of vibration is significantly dependent on where the user holds the applicator. For example, when the user holds a portion close to the vibration motor, the amplitude of both the vibration motor and the brush is substantially reduced; and when the user holds a portion remote from the vibration motor, the amplitude of the vibration motor will become uncontrolled such that the brush vibrates violently and rotates very quickly, causing great trouble to the user.

SUMMARY OF THE INVENTION

The main object of the present invention is to provide a makeup applicator, in which an applying element thereof can vibrate and rotate steadily.

To achieve the above object, a makeup applicator is provided. The applicator includes a main body, a holding portion, a cushion sleeve, a shaft, a covering ring, an applying element and a rotating rod. The main body includes a vibration motor assembly and a case, the holding portion covers the vibration motor assembly, and the cushion sleeve is sandwiched between the main body and the holding portion.

Therefore, the applying element can be driven to vibrate and rotate steadily by the vibration motor assembly no matter where the user holds the holding portion, which facilitates the users makeup.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
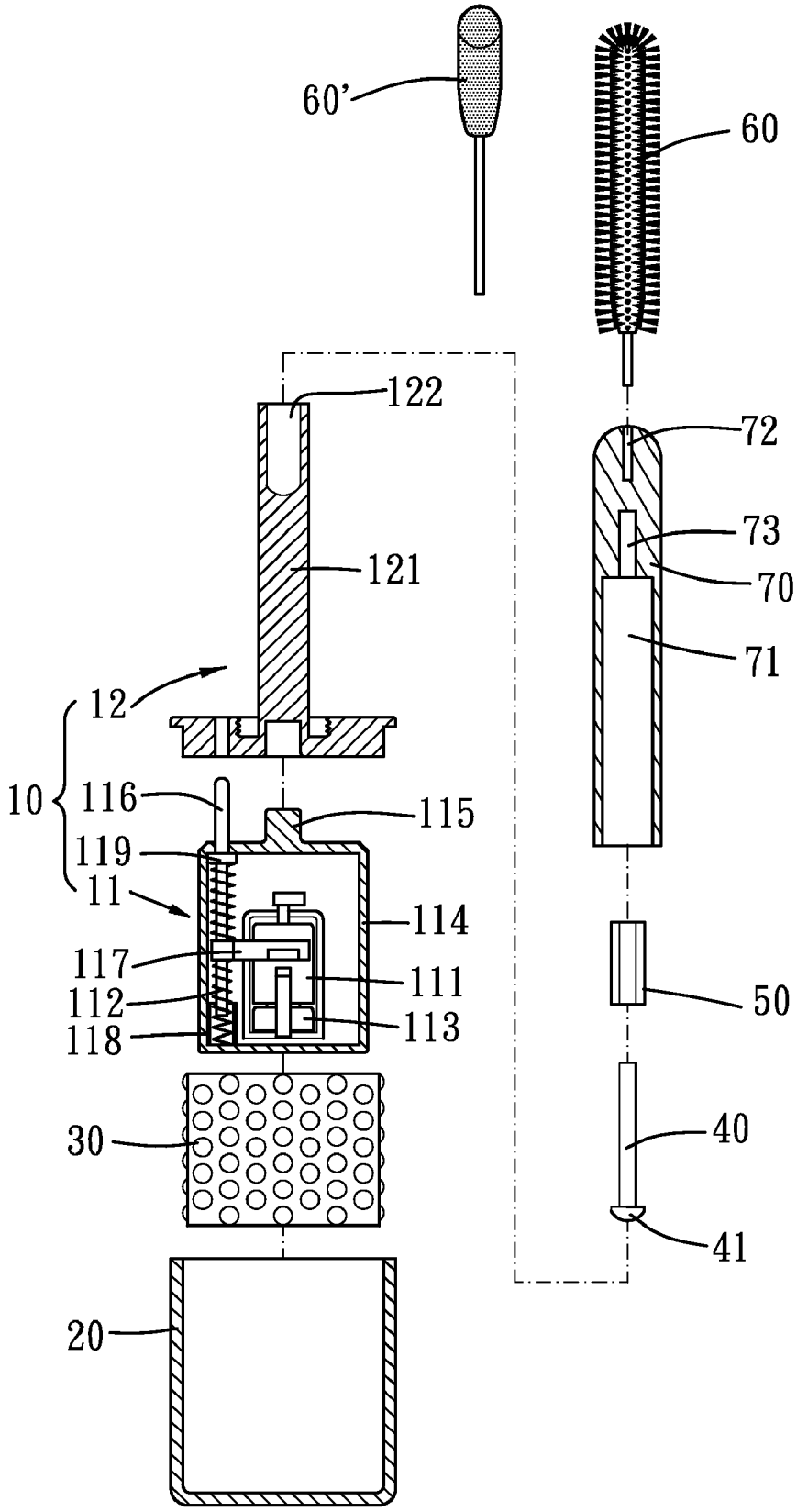
FIG. 1 is a breakdown drawing showing a makeup applicator in accordance with a first embodiment of the present invention.

Please refer to FIG. 1. The makeup applicator of the present invention includes a main body 10, a holding portion 20, a cushion sleeve 30, a shaft 40, a covering ring 50, an applying element 60 and a rotating rod 70. And the main body 10 includes a vibration motor assembly 11 and a cover 12.

The vibration motor assembly 11 includes a vibration motor 111, a switch 112, a power source 113 and a case 114. The power source 113 can be a battery and installed in the case 114 along with the vibration motor 111. The case 114 has a combining portion 115 extending therefrom to combine with the cover 12. In addition, the switch selectively electrically communicates the vibration motor 111 and the power source 113. The holding portion 20 covers the vibration motor assembly 11, and the cushion sleeve 30 is sandwiched between the main body 10 and the holding portion 20.

In the present embodiment, the switch 112 includes an abutting rod 116, an insulation plate 117 disposed in a predetermined position of the abutting rod 116, a socket 118 fixed on the case 114, an upper spring and a lower spring, in which one end of the abutting rod 116 extends through the socket 118, and a rim 119 is disposed on a portion of the abutting rod 116 away from the socket 118. Two ends of the upper spring abut against the rim 119 and the insulation plate 117 respectively, and two ends of the lower spring abut against the insulation plate 117 and the socket 118 respectively. By that means, when the abutting rod 116 is pushed into the case 114 by an external force, the insulation plate 117 is also moved downward to isolate the vibration motor 111 from an electrode of the power source 113, turning off the vibration motor 111; and when the external force is gone, the abutting rod 116 returns to its prior position by the lower spring, and the power source 113 again electronically connects to the vibration motor 111 to make it function. The upper spring of the present embodiment can be replaced by a rod with two ends thereof abutting against the rim 119 and the insulation plate 117 to perform the above-mentioned function.

Moreover, one side of the cover 12 is attached to the combining portion 115, and an opposite side of the cover 12 axially and outwardly extending an extending base 121. A free end of the extending base 121 is axially disposed a hollow concave round hole 122 with a bore diameter thereof smaller than an outer diameter of the extending base 121.

Furthermore, one end of the shaft 40 has an annular flange 41 with a largest diameter thereof bigger than the outer diameter of the shaft 40 and slightly smaller than the bore diameter of the round hole 122, such that the annular flange 41 is rotatably installed in the round hole 122. And another end of the shaft axially extending out of the round hole 122. In addition, the covering ring 50 is installed between a side wall of the round hole 122 and the shaft 40, and an inner diameter of the covering ring 50 is smaller than the largest diameter of the annular flange 41 so as to prohibit the annular flange 41 from leaving the round hole 122.

Both ends of the rotating rod 70 are disposed a first receiving room 71 and a second receiving room 72. The first receiving room 71 receives and sleeves around the extending base 121, and one end of the applying element 60 is detachably installed in the second receiving room 72. A third receiving room 73 communicating the first receiving room 71 is disposed on the rotating rod 70, while the end of the shaft 40 away from the annular flange 41 is securely received therein. In the present embodiment, the applying element 60 is a brush for applying mascara, yet it can still be replaced by the applying element 60' as a brush for applying lip gloss when desired.

Figure 2A:
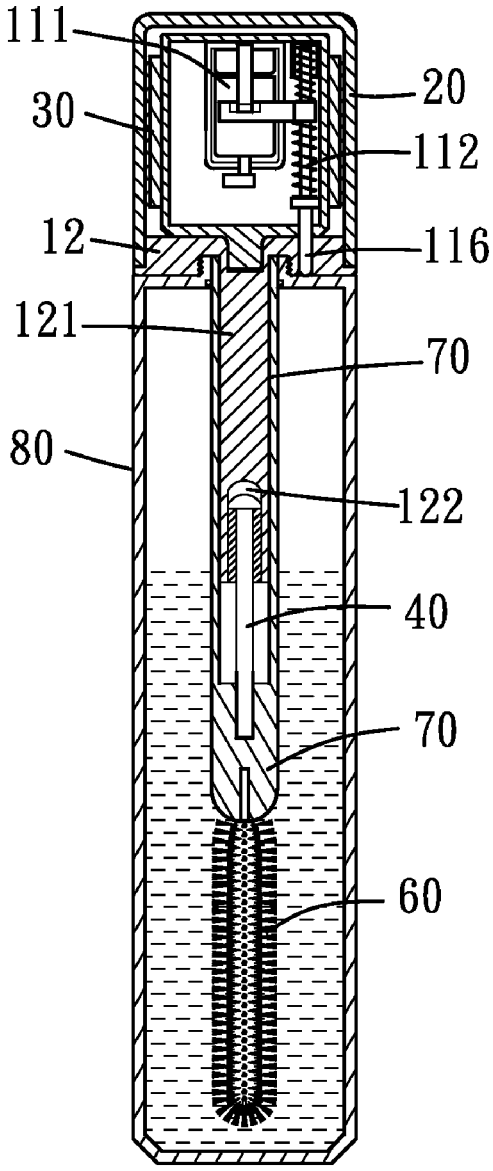
FIG. 2A is a profile showing a makeup applicator in accordance with a first embodiment of the present invention.
Figure 2B:
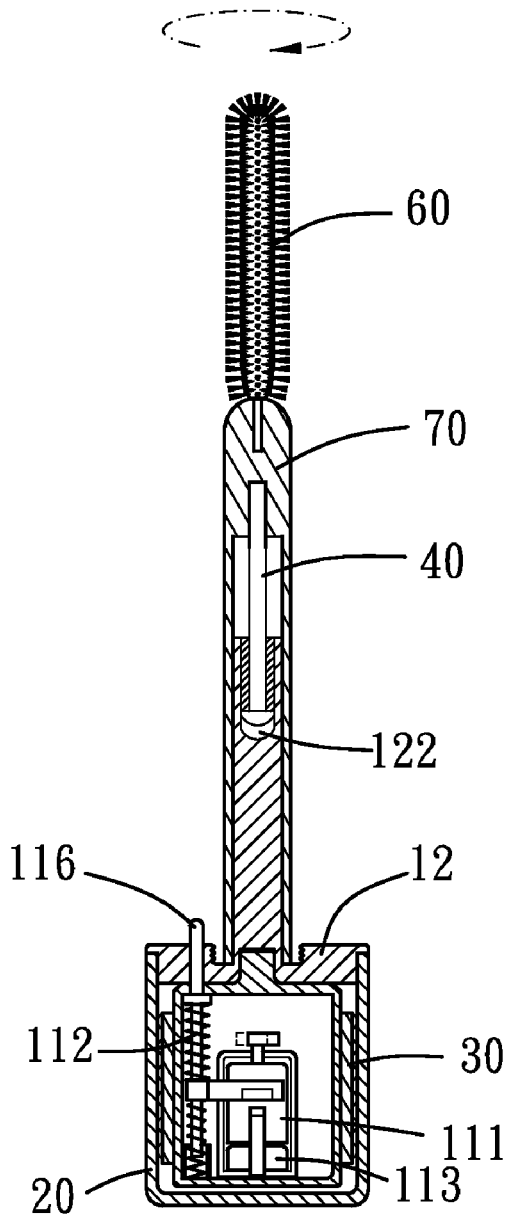
FIG. 2B is a profile showing a usage state of a makeup applicator in accordance with a first embodiment of the present invention.

Please refer to FIG. 2A and FIG. 2B. The makeup applicator further includes a bottle 80 for receiving the applying element 60 therein, and the bottle 80 can be covered by the cover 12. In addition, the bottle 80 is filled with mascara or other cosmetic liquid or gel, and an outer surface thereof is disposed a mirror (undepicted). Furthermore, due to the full coverage of the rotating rod 70 over the extending base 121, the cosmetic liquid in the bottle 80 will not permeate into the round hole 122, nor will it dry up around the shaft 40 to make the shaft 40 stuck and nonrotatable in the round hole 122. Moreover, the bottle 80 abuts against the abutting rod 116 of the switch 112, so that the vibration motor 111 will be turned on when the bottle 80 is loosened from the cover 12 and disengaged from the abutting rod 116. Further due to the fact that the cushion sleeve 30 disposed around the vibration motor assembly 11, the amplitude of the vibration motor assembly 11 is hardly limited no matter where the user holds the holding portion 20. Therefore, the vibration motor assembly 11 can function just as what it is designed, allowing the applying element 60 to be driven to rotate and vibrate steadily.

Figure 2C:
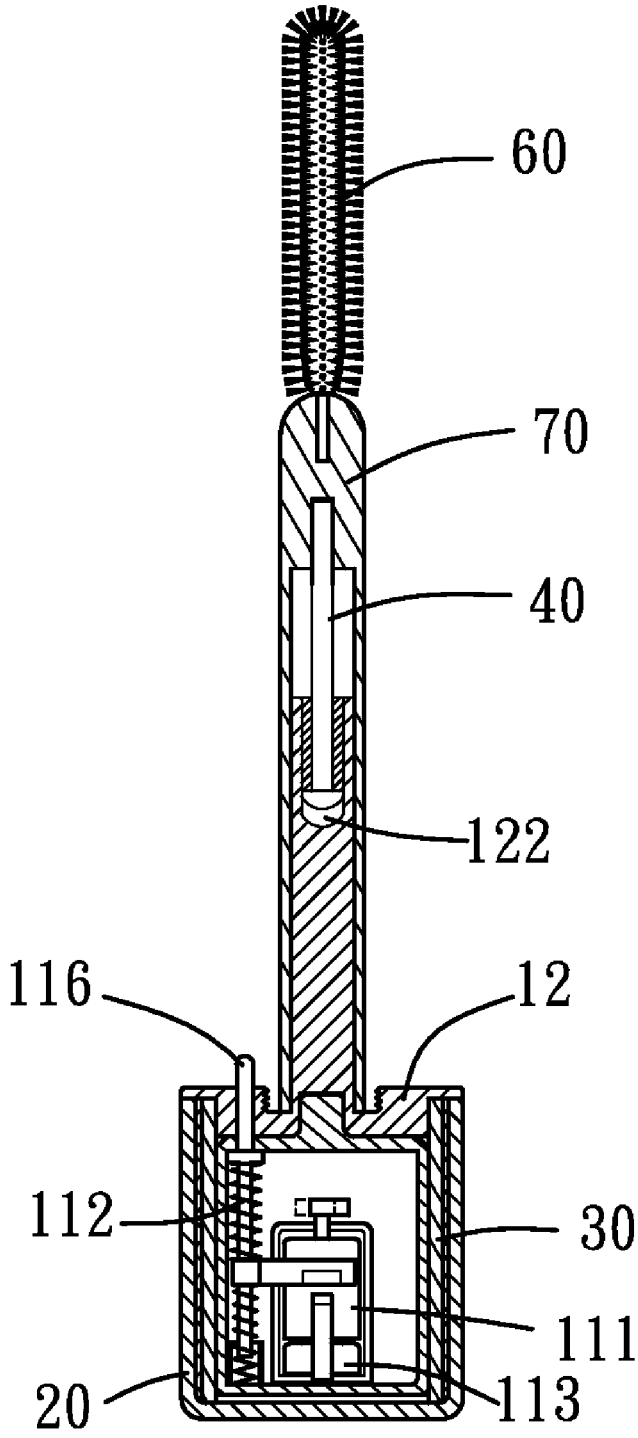
FIG. 2C is a profile showing a makeup applicator in accordance with a second embodiment of the present invention.

As shown in FIG. 2C, the cushion sleeve 30 also sleeves around a part of the cover 12 so that the vibration motor assembly 11 is substantially suspended in the holding portion 20 to minimize the degree of the amplitude lost thereof.

Figure 3A:
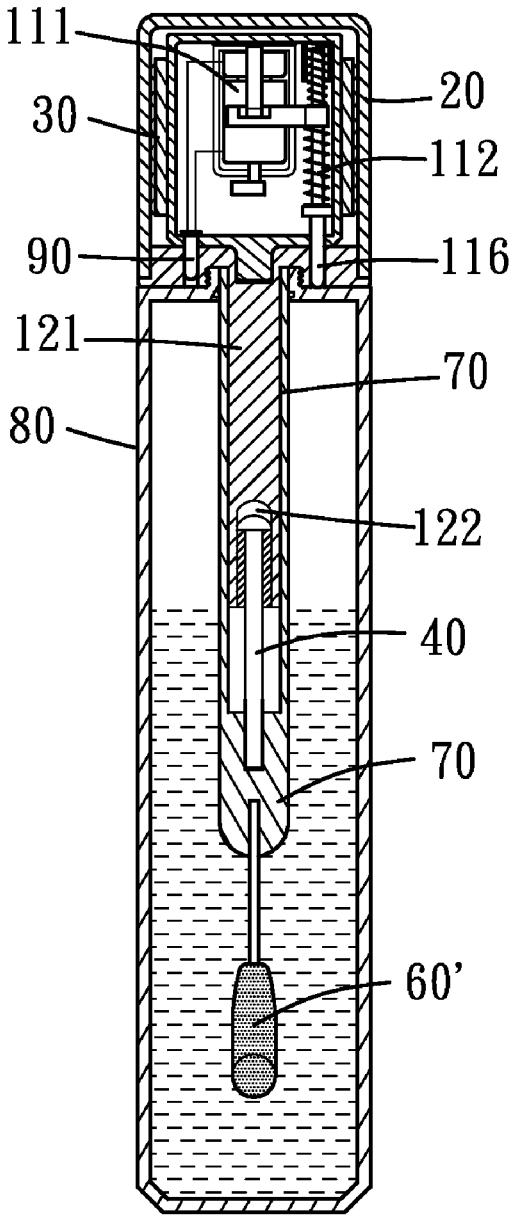
FIG. 3A is a profile showing a makeup applicator in accordance with a third embodiment of the present invention.
Figure 3B:
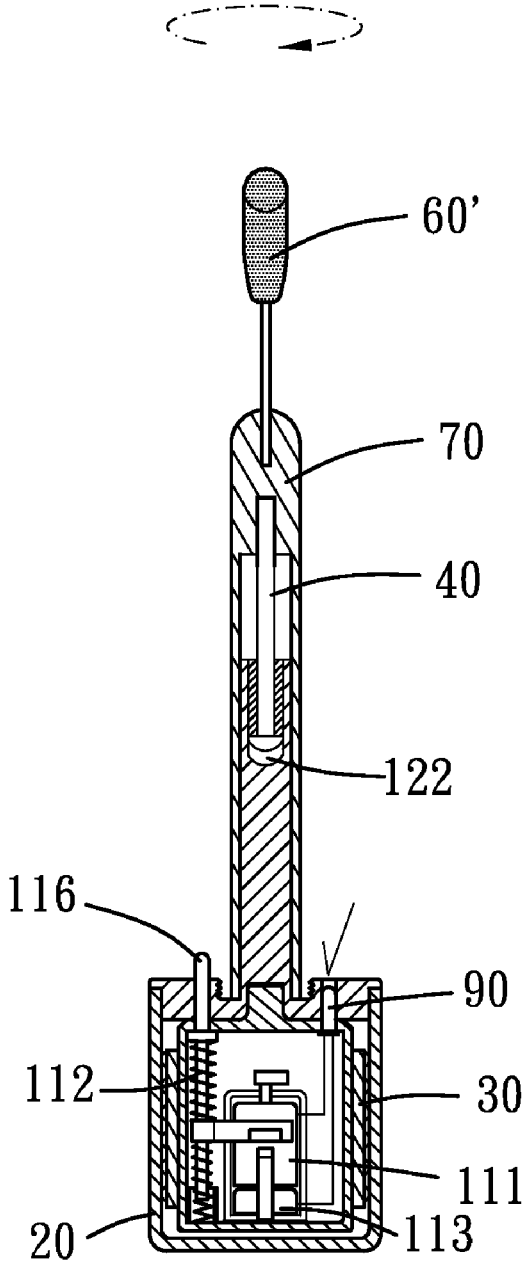
FIG. 3B is a profile showing a usage state of a makeup applicator in accordance with a third embodiment of the present invention.

Please refer to FIG. 3A and FIG. 3B. The makeup applicator further includes a LED light source 90 disposed in a predetermined position of the main body 10. More specifically, the LED light source 90 is disposed in a bore of the cover 12 for emitting light toward the applying element 60', in which the LED light source 90 is also selectively electronically communicated with the power source 113 by the switch 112. Therefore, when the switch 112 is turned on, the vibration motor 111 and the LED light source 90 function simultaneously; and when the switch 112 is turned off, the vibration motor 111 and the LED light source 90 are then shut down.

In the above-described embodiment, the switch 112 is designed to abut against the bottle 80 to control its on/off, yet the switch 112 can also be designed in another way that its on/off is controlled by a manual portion (undepicted) disposed in a predetermined positioned of the holding portion 20, such that the user can decide when to turn on the vibration motor and/or the LED light source.

What is claimed is:

1. A makeup applicator, comprising:

a main body, comprising a vibration motor assembly and a cover, the vibration motor assembly comprising a vibration motor, a switch, a power source and a case, wherein the vibration motor is installed in the case, the case having a combining portion, and the switch selectively electronically communicates the vibration motor and the power source;

one side of the cover being attached to the combining portion, and an opposite side of the cover axially and outwardly extending an extending base, a free end of the extending base being axially disposed a hollow concave round hole;

a holding portion, covering the vibration motor assembly;

a cushion sleeve, sandwiched between the main body and the holding portion;

a shaft, one end thereof having an annular flange with a largest diameter thereof bigger than the outer diameter of the shaft and slightly smaller than the bore diameter of the round hole, the annular flange being rotatably installed in the round hole, and another end of the shaft axially extending out of the round hole;

a covering ring, installed between a side wall of the round hole and the shaft, and an inner diameter of the covering ring being smaller than the largest diameter of the annular flange;

an applying element; and a rotating rod, connecting the applying element to the end of the shaft away from the annular flange.

2. The makeup applicator as claimed in claim 1, wherein both ends of the rotating rod are disposed a first receiving room and a second receiving room respectively, the first receiving room receives the extending base, and one end of the applying element is detachably installed in the second receiving room, the rotating rod further has a third receiving room communicating the first receiving room, the end of the shaft away from the annular flange is securely received in the third receiving room.

3. The makeup applicator as claimed in claim 2, further comprising a bottle for receiving the applying element therein, and the bottle being covered by the cover.

4. The makeup applicator as claimed in claim 3, wherein the bottle abuts against the switch, so that switch electronically communicates the vibration motor and the power source when the bottle is separated from the cover.

5. The makeup applicator as claimed in claim 3, further comprising a mirror disposed on an outer surface of the bottle.

6. The makeup applicator as claimed in claim 1, wherein the applying element is a brush for applying mascara.

7. The makeup applicator as claimed in claim 1, wherein the applying element is a brush for applying lip gloss.

8. The makeup applicator as claimed in claim 7, further comprising a light source for emitting light toward the applying element disposed in a predetermined position of the main body, and the switch selectively electronically communicating the light source and the power source.

9. The makeup applicator as claimed in claim 1, wherein the switch has a manual portion disposed in a predetermined positioned of the holding portion.

10. The makeup applicator as claimed in claim 1, wherein the switch comprises an abutting rod, an insulation plate disposed in a predetermined position of the abutting rod, a socket fixed on the case, an upper spring and a lower spring, wherein one end of the abutting rod extends through the socket, and a rim is disposed on a portion of the abutting rod away from the socket, two ends of the upper spring abut against the rim and the insulation plate respectively, and two ends of the lower spring abut against the insulation plate and the socket respectively, and the insulation plate selectively isolates the vibration motor from an electrode of the power source.

* * * * *